US008471792B2

(12) United States Patent
Chen et al.

(10) Patent No.: US 8,471,792 B2
(45) Date of Patent: Jun. 25, 2013

(54) DISPLAY DEVICE AND DRIVING METHOD OF THE SAME

(75) Inventors: Ken-Ming Chen, Hsin-Chu (TW); Chi-Mao Hung, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1060 days.

(21) Appl. No.: 12/371,946

(22) Filed: Feb. 17, 2009

(65) Prior Publication Data

US 2010/0053047 A1 Mar. 4, 2010

(30) Foreign Application Priority Data

Aug. 28, 2008 (TW) ..... 97132975 A

(51) Int. Cl.
*G09G 3/20* (2006.01)

(52) U.S. Cl.
USPC ..... 345/84; 345/87; 345/98; 345/99; 345/100; 345/104; 315/169.1; 315/169.2; 315/169.3; 315/169.4

(58) Field of Classification Search
USPC ..... 345/84, 87, 98, 99, 100, 104; 315/169.1, 315/169.2, 169.3, 169.4
See application file for complete search history.

(56) References Cited

U.S. PATENT DOCUMENTS

| | | | | |
|---|---|---|---|---|
| 5,436,635 | A * | 7/1995 | Takahara et al. | 345/92 |
| 5,448,258 | A * | 9/1995 | Edwards | 345/90 |
| 5,506,598 | A * | 4/1996 | Shimada et al. | 345/92 |
| 5,903,249 | A | 5/1999 | Koyama et al. | |
| 6,492,972 | B1 * | 12/2002 | Kubota et al. | 345/100 |
| 7,453,426 | B2 * | 11/2008 | Yamazaki | 345/76 |
| 7,847,773 | B2 * | 12/2010 | Chiang et al. | 345/93 |
| 2006/0208984 | A1 * | 9/2006 | Kim et al. | 345/90 |
| 2010/0109738 | A1 * | 5/2010 | Chien et al. | 327/295 |

* cited by examiner

*Primary Examiner* — Joseph Haley
*Assistant Examiner* — Linh N Hoffner
(74) *Attorney, Agent, or Firm* — WPAT, PC; Justin King

(57) ABSTRACT

A display device includes a data line, a first and second pixel rows and a first and second gate control lines all formed on a substrate. The first pixel row includes a plurality of pixels each containing two neighboring first sub-pixel and second sub-pixel, the first sub-pixel is coupled to the data line, the second sub-pixel is coupled to the data line through the first sub-pixel. The second pixel row is neighboring with the first pixel row and includes a plurality of pixels each containing two neighboring third sub-pixel and fourth sub-pixel, the third sub-pixel is coupled to the data line, the fourth sub-pixel is coupled to the data line through the third sub-pixel. The first and second gate control lines respectively are for enabling the first and second sub-pixels and both are not used to enable the third and fourth sub-pixels. A driving method of gate control lines also is provided.

5 Claims, 4 Drawing Sheets

DISPLAY DEVICE AND DRIVING METHOD OF THE SAME

CROSS-REFERENCE TO RELATED APPLICATIONS

This application is based upon and claims the benefit of priority from the prior Taiwanese Patent Application No. 097132975, filed Aug. 28, 2008, the entire contents of which are incorporated herein by reference.

BACKGROUND

1. Technical Field

The present invention generally relates to display technology fields and, particularly to a display device and a driving method of gate control lines in which driving signals for the gate control lines are single-pulse signals.

2. Description of the Related Art

Display devices such as a liquid crystal display (LCD) and a plasma display have the advantages of high image quality, small size, light weight and a broad application range, and thus are widely applied on consumer electronic products such as a mobile phone, a notebook computer, a desktop display and a television, and have gradually replaced the traditional cathode ray tube (CRT) displays as the main trend in the display industry.

Referring to FIG. 3, a schematic partial view of a conventional display device 30 is shown. The display device 30 includes a substrate 32, a plurality of pixel rows R1~R4, a plurality of gate control lines G0~G4, a plurality of data lines S0~S3, a dummy data line DUM and a plurality of dummy pixels 33. The pixel rows R1~R4, the gate control lines G0~G4, the data lines S0~S3, the dummy data line DUM and the dummy pixels 33 all are formed on the substrate 32. The dummy pixels 33 respectively are formed at the outside of the heads (or tails) of the pixel rows R1~R4. The dummy pixels 33 are located at respective intersections of the gate control lines G0~G3 and the dummy data line DUM and each contain two neighboring sub-pixels 331, 333 electrically coupled with each other. The pixel rows R1~R4 each include a plurality of pixels 31 located at respective intersections of the gate control lines G0~G3 and the data lines S0~S2. Each of the pixels 31 contains two neighboring sub-pixels 311, 313, the sub-pixel 311 is electrically coupled to a corresponding one of the data lines S0~S3 to receive a data signal provided by the corresponding one data line, and the sub-pixel 313 is electrically coupled to the sub-pixel 311 to receive a data signal provided by the corresponding one data line through the sub-pixel 311. Each of the gate control lines G1~G3 is for enabling the sub-pixels 311 of one pixel row and the sub-pixels 313 of the neighboring one pixel row.

Referring to FIG. 4, showing timing diagrams of driving signals respectively for driving the gate control lines G0~G4 of the display device 30. As seen from FIGS. 3 and 4, because each of the gate control lines G1~G3 is for enabling corresponding sub-pixels in two neighboring pixel rows, which results in the driving signals as required are multi-pulse signals.

However, since the current gate-on-array (GOA) circuit having a relatively low cost only can generate single-pulse signals and thus could not be used to generate the multi-pulse signals to meet the requirement of the display device 30. Therefore, the GOA circuit could not used in the foregoing display device 30 to replace the traditional integrated gate driver circuit so as to reduce the cost in relation to the gate driving part. From this point, the display device 30 still exists the possibility to further reduce cost.

BRIEF SUMMARY

The present invention relates to a display device, driving signals for driving gate control lines thereof being single-pulse signals and thus the use of GOA circuit being feasible.

The present invention further relates to a driving method of gate control lines, driving signals for driving the gate control lines being single-pulse signals and thus the use of GOA circuit being feasible.

In order to achieve the above-mentioned advantages, a display device in accordance with an embodiment of the present invention is provided. The display device includes a substrate, a data line, a first pixel row, a second pixel row, a first gate control line and a second gate control line. The data line, the first pixel row, the second pixel row, the first gate control line and the second gate control line all are formed on the substrate. The first pixel row includes a plurality of pixels each of which contains a first sub-pixel and a second sub-pixel neighboring with each other. The first sub-pixel is electrically coupled to the data line to receive a signal provided by the data line. The second sub-pixel is electrically coupled to the first sub-pixel to receive a signal provided by the data line through the first sub-pixel. The second pixel row is neighboring with the first pixel row. The second pixel row includes a plurality of pixels each of which contains a third sub-pixel and a fourth sub-pixel neighboring with each other. The third sub-pixel is electrically coupled to the data line to receive a signal provided by the data line. The fourth sub-pixel is electrically coupled to third sub-pixel to receive a signal provided by the data line through the third sub-pixel. The first gate control line is for enabling the first sub-pixel. The second gate control line is for enabling the second sub-pixel. The first gate control line and the second gate control line both are not used to enable the third sub-pixel and the fourth sub-pixel.

In one embodiment, the display device further includes a first GOA circuit and a second GOA circuit both formed on the substrate, the first gate line is electrically coupled to the first GOA circuit and the second gate line is electrically coupled to the second GOA circuit. The substrate can be a glass substrate.

In one embodiment, a dummy pixel is formed at the outside of the head or tail of each of the first and second pixel rows, the dummy pixel contains a fifth sub-pixel and a sixth sub-pixel neighboring with each other.

A driving method of gate control lines in accordance with another embodiment of the present invention is provided. The driving method of gate control lines is implemented in the above-mentioned display device. The driving method of gate control lines includes: providing a first driving signal to the second gate control line to enable the second sub-pixel, the first driving signal being a single-pulse signal and containing a first pulse; and providing a second driving signal to the first gate control line to enable the first sub-pixel, the second driving signal being a single-pulse signal and containing a second pulse; wherein the first pulse is prior to the second pulse and has a partial time overlap with the second pulse.

In one embodiment, the first pulse and second pulses have a same pulse width. Furthermore, the partial time overlap between the first and second pulses occupies a half of the pulse width.

In one embodiment, the partial time overlap between the first and second pulses occupies a half of a pulse width of the first pulse.

In one embodiment, the driving method of gate control lines further includes: generating the first driving signal by the second GOA circuit; and generating the second driving signal by the first GOA circuit.

In regard to the display device in accordance with the above-mentioned embodiment, the driving signals required by the gate control lines thereof are single-pulse signals, which allows the use of GOA circuits for the generation of the driving signals to be feasible. Accordingly, the cost in relation to the gate driving part of the display device can be further reduced.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
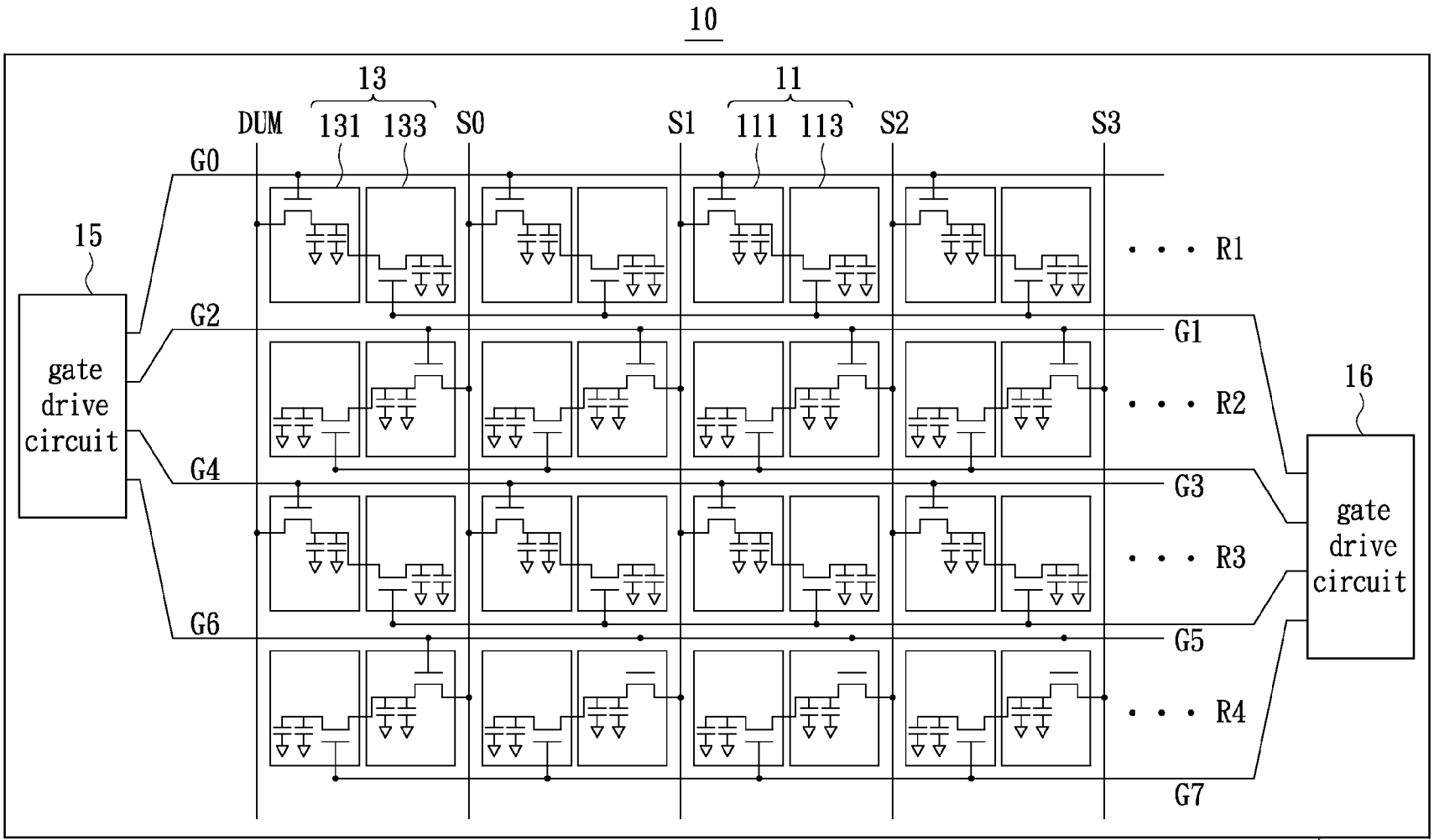
FIG. 1 is structural partial view of a display device in accordance with an embodiment of the present invention.

Referring to FIG. 1, a schematic partial view of a display device 10 in accordance with an embodiment of the present invention is shown. The display device 10 can be a flat panel display device such as a liquid crystal display, a plasma display and etc. As shown in FIG. 1, the display device 10 includes a substrate 12, a plurality of pixel rows R1~R4, a plurality of first gate control lines G0, G2, G4 and G6, a plurality of second gate control lines G1, G3, G5 and G7, a plurality of data lines S0~S3, a dummy data line DUM, a plurality of dummy pixels 13 and gate drive circuits 15, 16. The pixel rows R1~R4, the first gate control lines G0, G2, G4 and G6, the second gate control lines G1, G3, G5 and G7, the data lines S0~S3, the dummy data line DUM, the dummy pixels 13 and the gate drive circuits 15, 16 all are formed on the substrate 12. The substrate 12 can be a glass substrate. The gate drive circuits 15, 16 are gate-on-array (GOA) circuits. Each of the pixel rows R1~R4 includes a plurality pixels 11 arranged in a row. The pixels 11 of the pixel rows R1~R4 are located respective intersections of the first gate control lines G0, G2, G4, G6 and the data lines S0~S2. It is understood that the pixels 11 of the pixel rows R1~R4 also are located respective intersections of the second gate control lines G1, G3, G5, G7 and the data lines S0~S2. The first gate control lines G0, G2, G4 and G6 are electrically coupled to the gate drive circuit 15, and the second gate control lines G1, G3, G5 and G7 are electrically coupled to the gate drive circuit 16.

Each pixel 11 contains a first sub-pixel 111 and a second sub-pixel 113. The first sub-pixel 111 is electrically coupled to a corresponding one of the data lines S0~S3 to receive a signal provided by the corresponding one data line, and the second sub-pixel 113 is electrically coupled to the first sub-pixel 111 to receive a signal provided by the corresponding one data line through the first sub-pixel 111. The first sub-pixel 111 and the second sub-pixel 113 of each of the pixels 11 each contain a thin film transistor (not labeled in FIG. 1), a storage capacitor (not labeled in FIG. 1) and a pixel capacitor (not labeled in FIG. 1), a gate electrode of the thin film transistor of the first sub-pixel 111 is electrically coupled to a corresponding one of the first gate control lines G0, G2, G4 and G6 so that the first sub-pixel 111 can be enabled by the corresponding one first gate control line, a gate electrode of the thin film transistor of the second sub-pixel 113 is electrically coupled to a corresponding one of the second gate control lines G1, G3, G5 and G7 so that the second sub-pixel 113 can be enabled by the corresponding one second gate control line.

As seen from FIG. 1, the pixels of each of the pixel rows R1~R4 are enabled by one first gate control line and one second gate control line, and the first gate control line and second gate control line for enabling the pixels 11 of one pixel row are not used to enable the pixels 11 of the neighboring one pixel row. Taken the neighboring pixel rows R1, R2 as one example: the pixel row R1 makes use of the first gate control line G0 and the second gate control line G1 to enable the pixels 11 thereof, the pixel row R2 makes use of the first gate control line G2 and the second gate control line G3 to enable the pixels 11 thereof. That is to say, the first gate control line G0 and the second gate control line G1 are not used to enable the pixels 11 of the pixel row R2; likewise, the first gate control line G2 and the second gate control line G3 are not used to enable the pixels 11 of the pixel row R1.

Referring to FIG. 1 again, the dummy pixels 13 respectively are formed at the outside of the heads or tails of the pixel rows R1~R4. Each of the dummy pixels 13 contains two neighboring sub-pixels 131, 133, the sub-pixel 131 is electrically coupled to the dummy data line DUM or the data line S0, and the sub-pixel 133 is electrically coupled to the dummy data line DUM or the data line S0 through the sub-pixel 131.

Figure 2:
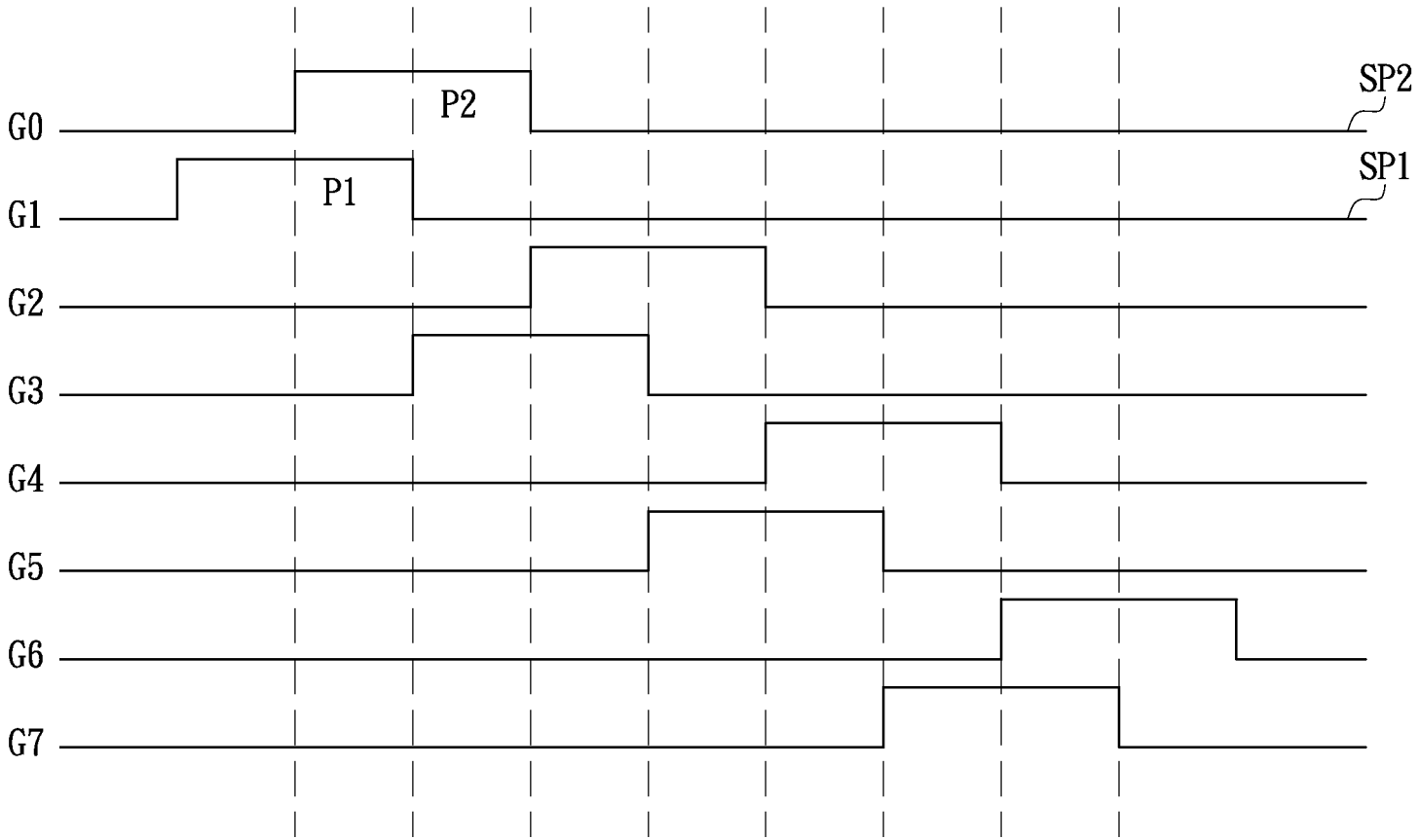
FIG. 2 shows timing diagrams of driving signal for driving gate control lines of the display device of FIG. 1.
Figure 3:
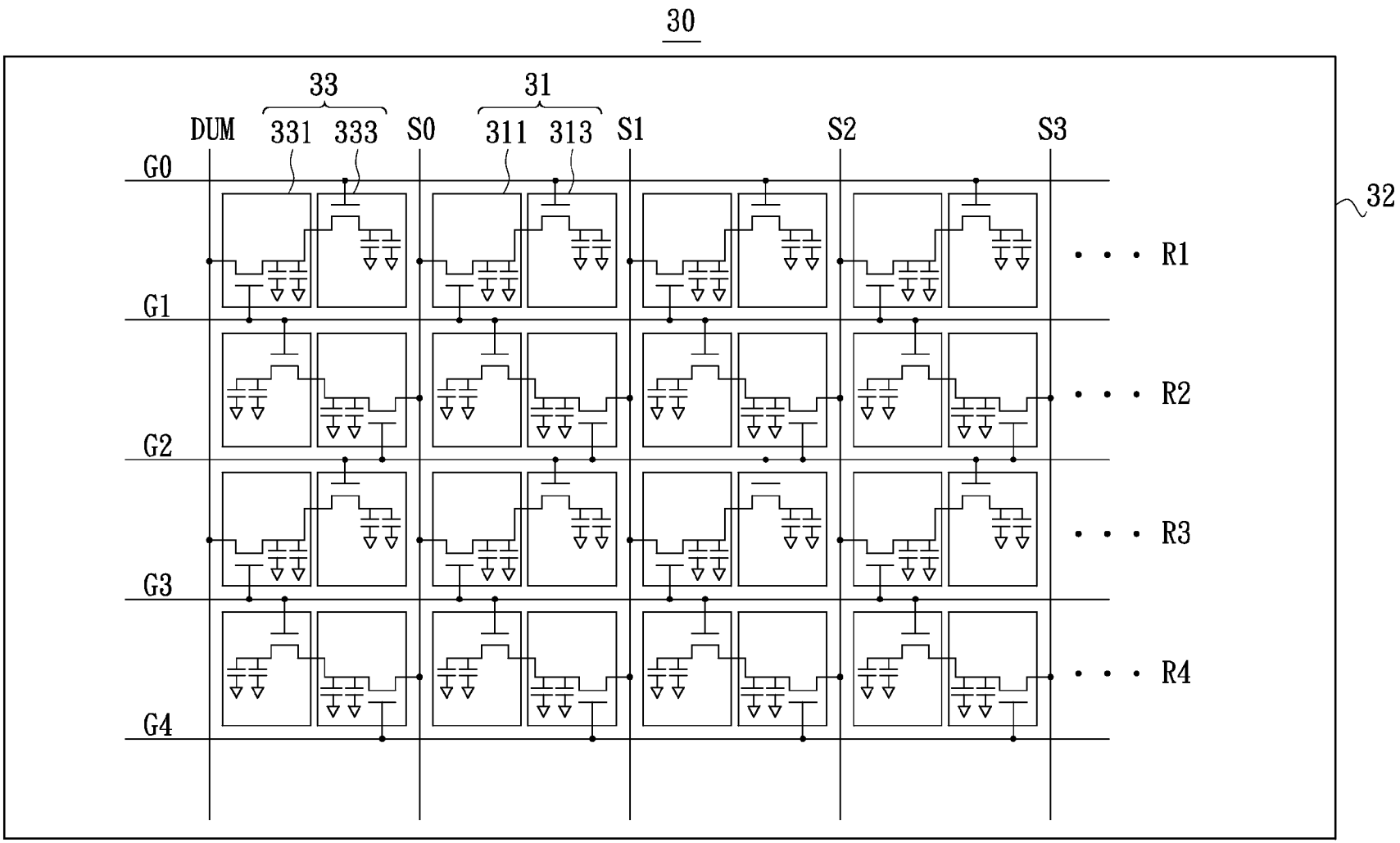
FIG. 3 (Prior Art)
FIG. 3 is a schematic partial view of a conventional display device.
Figure 4:
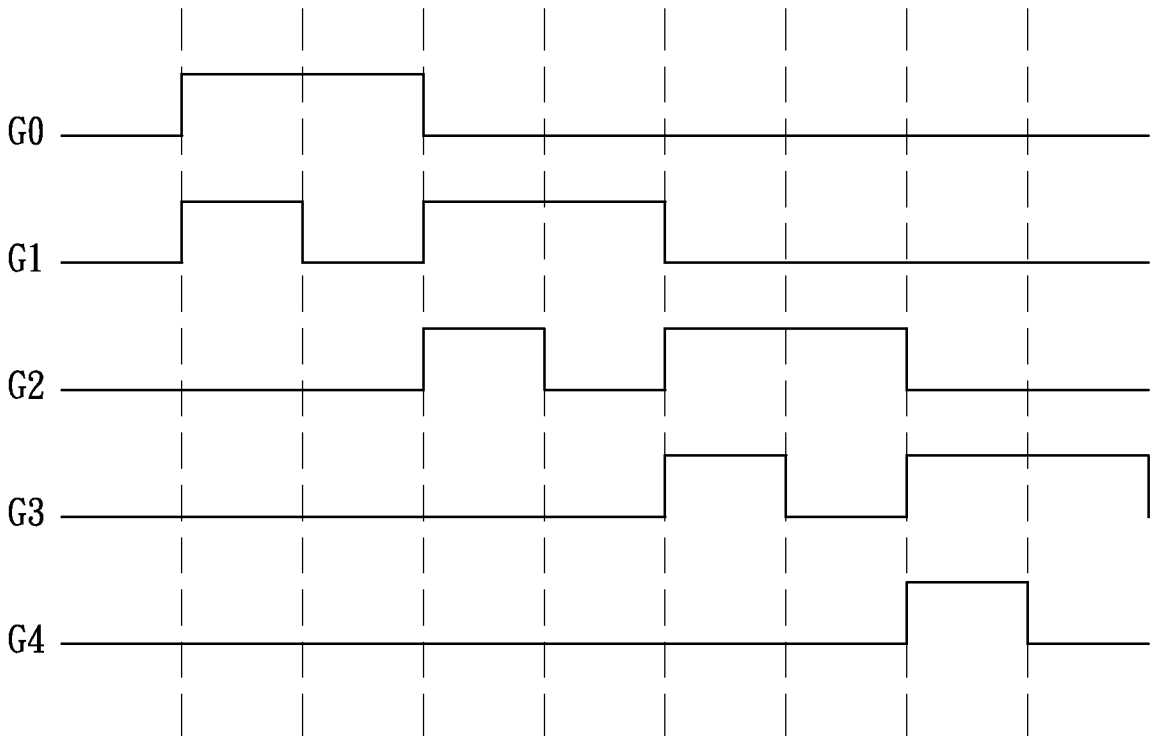
FIG. 4 (Prior Art)
FIG. 4 shows timing diagrams of driving signal for driving gate control lines of the display device of FIG. 3.

Referring to FIG. 2, showing timing diagrams of driving signals for driving the first gate control lines G0, G2, G4, G6 and the second gate control lines G1, G3, G5 and G7 of the display device 10. A driving method of gate control lines implemented in the display device 10 will be described below in detail with reference to FIGS. 1 and 2. Since driving methods of the first gate control line and the second gate control line used in the respective pixel rows R1~R4 are the same, the driving method of the first gate control line G0 and the second gate control line G1 used in the pixel row R1 hereinafter is taken as an example to illustrate the driving method of gate control lines in accordance with the present embodiment. The driving method of the gate control line G0 and the second gate control line G1 used in the pixel row R1 will be described below in detail.

A first driving signal SP0 is provided to the second gate control line G1 to enable the second sub-pixels 113 of the pixel row R1 electrically coupled to the second gate control line G1. The first driving signal SP1 is a single-pulse signal and contains a first pulse P1. The first driving signal SP1 is generated by the gate drive circuit 16. A second driving signal SP2 is provided to the first gate control line G0 to enable the first sub-pixel 111 of the pixel row R1 electrically coupled to the first gate control line G0. The second driving signal SP2 is a single-pulse signal and contains a second pulse P2. The second driving signal SP2 is generated by the gate drive circuit 15.

As seen from FIG. 2, the first pulse P1 is prior to the second pulse P2 and has a partial time overlap with the second pulse P2. The first pulse P1 and the second pulse P2 has a same pulse width, and the partial time overlap between the first pulse P1 and the second pulse P2 occupies a half of the pulse width. In other circumstance, when a pulse width of the first pulse P1 is different from that of the second pulse P2, the partial time overlap between the first pulse P1 and the second pulse P2 can be set to occupy a half of the pulse width of the first pulse P1. In summary, with regard to the display device in accordance with the above-mentioned embodiment of the present invention, the driving signals required by the gate control lines are single-pulse signals, which allows the use of the gate-on-array circuits in the present display device for the generation of the driving signals to be feasible. Accordingly, the cost in relation to the gate driving part of the present display device can be reduced. In addition, the gate drive circuits 15, 16 in accordance with the above-mentioned embodiment are not limited to GOA circuits and can be integrated gate driver circuits instead. The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving method of gate control lines, implemented in a display device, which has:

a substrate;

a data line, formed on the substrate;

a first pixel row, formed on the substrate and comprising a plurality of pixels each of which containing a first sub-pixel and a second sub-pixel neighboring with each other, wherein the first sub-pixel is electrically coupled to the data line to receive a signal provided by the data line, and the second sub-pixel is electrically coupled to the first sub-pixel to receive a signal provided by the data line through the first sub-pixel;

a second pixel row formed on the substrate and neighboring with the first pixel row, the second pixel row comprising a plurality of pixels each of which containing a third sub-pixel and a fourth sub-pixel neighboring each other, wherein the third sub-pixel is electrically coupled to the data line to receive a signal provided by the data line, the fourth sub-pixel is electrically coupled to the third sub-pixel to receive a signal provided by the data line through the third sub-pixel;

a first gate control line formed on the substrate and being for enabling the first sub-pixel; and a second gate control line formed on the substrate and being for enabling the second sub-pixel;

wherein the first gate control line and the second gate control line both are not used to enable the third sub-pixel and the fourth sub-pixel, and the driving method comprising:

providing a first driving signal to the second gate control line to enable the second sub-pixel, the first driving signal being a single-pulse signal and containing a first pulse;

providing a second driving signal to the first gate control line to enable the first sub-pixel, the second driving signal being a single-pulse signal and containing a second pulse;

wherein the first pulse is prior to the second pulse and has a partial time overlap with the second pulse.

2. The driving method of gate control lines as claimed in claim 1, wherein the first pulse and the second pulse have a same pulse width.

3. The driving method of gate control lines as claimed in claim 2, wherein the partial time overlap occupies a half of the pulse width.

4. The driving method of gate control lines as claimed in claim 1, wherein the partial time overlap occupies a half of a pulse width of the first pulse.

5. The driving method of gate control lines as claimed in claim 1, wherein the display device further comprises a first gate-on-array circuit and a second gate-on-array circuit both formed on the substrate, and the driving method of gate control lines further comprises:

generating the first driving signal by the second gate-on-array circuit; and generating the second driving signal by the first gate-on-array circuit.

* * * * *